US009821370B2

(12) United States Patent
Go et al.

(10) Patent No.: US 9,821,370 B2
(45) Date of Patent: Nov. 21, 2017

(54) MOLD DEVICE FOR FORMING METAL IN HIGH-LEVEL VACUUM ENVIRONMENT

(71) Applicants: Dong Keun Go, Busan (KR); Myoung Su Go, Busan (KR)

(72) Inventors: Dong Keun Go, Busan (KR); Myoung Su Go, Busan (KR)

( * ) Notice: Subject to any disclaimer, the term of this patent is extended or adjusted under 35 U.S.C. 154(b) by 0 days.

(21) Appl. No.: 14/906,748

(22) PCT Filed: Jun. 5, 2015

(86) PCT No.: PCT/KR2015/005676

§ 371 (c)(1),
(2) Date: Jun. 16, 2016

(87) PCT Pub. No.: WO2016/006828

PCT Pub. Date: Jan. 14, 2016

(65) Prior Publication Data

US 2017/0106439 A1 Apr. 20, 2017

(30) Foreign Application Priority Data

Jul. 10, 2014 (KR) ..... 10-2014-0086829

(51) Int. Cl.
*B22D 17/14* (2006.01)
*B22D 17/22* (2006.01)
(Continued)

(52) U.S. Cl.
CPC ..... *B22D 27/15* (2013.01); *B22D 17/145* (2013.01); *B22D 17/2218* (2013.01); *B22D 17/2236* (2013.01); *B22D 29/00* (2013.01)

(58) Field of Classification Search
CPC ..... B22D 17/14; B22D 17/2236; B29C 45/40
(Continued)

(56) References Cited

U.S. PATENT DOCUMENTS 4,463,793 A * 8/1984 Thurner ..... B22D 17/14 164/155.4
6,648,054 B2 * 11/2003 Kuramasu ..... B22D 17/14 164/113
(Continued)

FOREIGN PATENT DOCUMENTS

CN 1202402 A 12/1998
CN 1876277 A 12/2006
(Continued)

OTHER PUBLICATIONS

KIPO Office Action dated Nov. 4, 2014.
(Continued)

*Primary Examiner* — Kevin E Yoon

(57) ABSTRACT

A mold device for forming metal in a high-level vacuum environment. The mold device comprises a fixed mold, a movable mold adjoining the upper portion of the fixed mold to form a mold cavity, a closing plate placed closely on top of the movable mold, and an ejector pin extending through the closing plate and the movable mold into the mold cavity. Packing is disposed in a hole in the closing plate through which the ejector pin extends, thereby preventing atmospheric air from entering the mold cavity. There is a blocking space between the movable mold and the packing to prevent heat from being transferred to the packing. An exhaust unit creates a vacuum environment by drawing air from the mold cavity. The metal product is pushed out by the ejector pin.

3 Claims, 10 Drawing Sheets

(51) Int. Cl.
*B22D 27/15* (2006.01)
*B22D 29/00* (2006.01)

(58) Field of Classification Search
USPC ..... 164/347
See application file for complete search history.

(56) References Cited

U.S. PATENT DOCUMENTS

| | | | | |
|---|---|---|---|---|
| 6,808,008 | B2 * | 10/2004 | Kubota | B22D 17/14 164/305 |
| 2006/0254747 | A1 * | 11/2006 | Ishida | B22D 17/12 164/312 |

FOREIGN PATENT DOCUMENTS

| | | | |
|---|---|---|---|
| CN | 1876278 | A | 12/2006 |
| CN | 1882403 | A | 12/2006 |
| CN | 1909996 | A | 2/2007 |
| CN | 201061825 | | 5/2008 |
| CN | 101704087 | A | 5/2010 |
| CN | 201644747 | U | 11/2010 |
| CN | 102451898 | A | 5/2012 |
| CN | 102642007 | A | 8/2012 |
| CN | 103639387 | A | 3/2014 |
| JP | 07043609 | U | 9/1995 |
| JP | 2002530199 | A | 9/2002 |
| JP | 2006263797 | A | 10/2006 |
| KR | 20090126171 | A | 12/2009 |
| KR | 20090126219 | | 12/2009 |
| KR | 20090126221 | A | 12/2009 |
| KR | 101188450 | B1 | 10/2012 |
| KR | 101517571 | B1 | 5/2015 |
| WO | 2004002658 | A1 | 1/2004 |

OTHER PUBLICATIONS

Office Action from Chinese Patent Office dated Nov. 18, 2016.
Office Action of Chinese Patent Office dated Dec. 1, 2016.
SIPO Office Action dated May 17, 2017.

* cited by examiner

[FIG. 1]
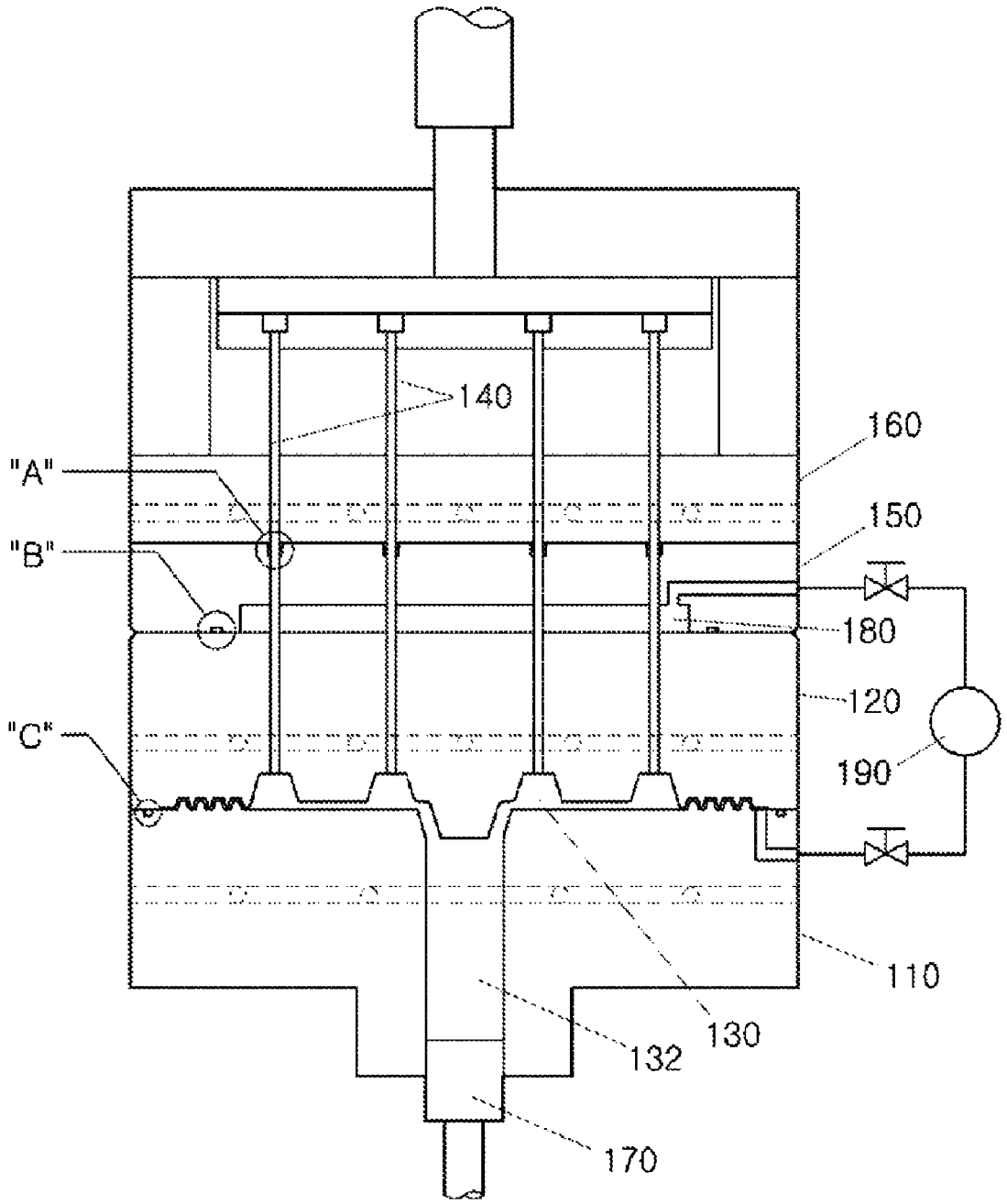

[FIG. 2]
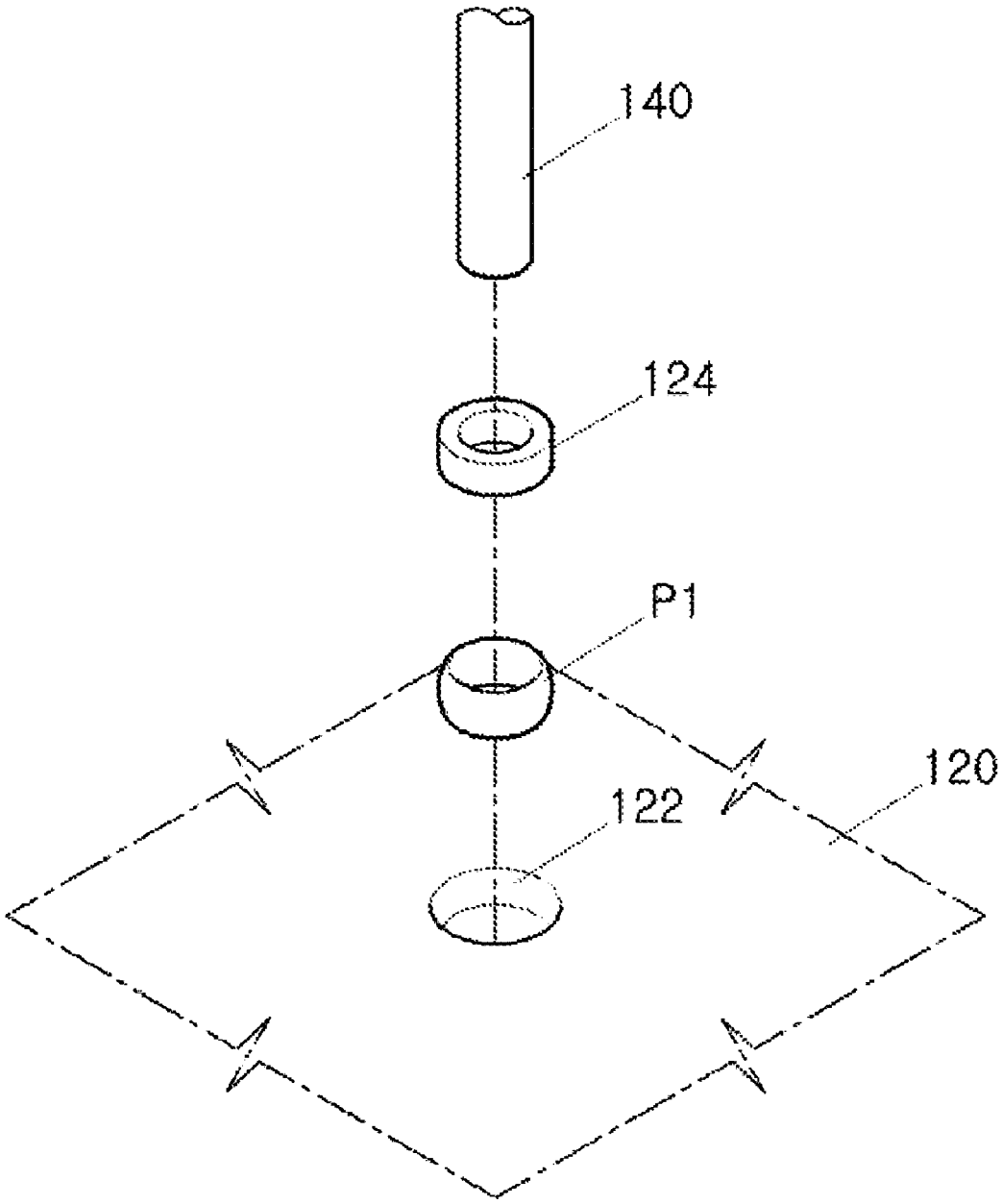

[FIG. 3]
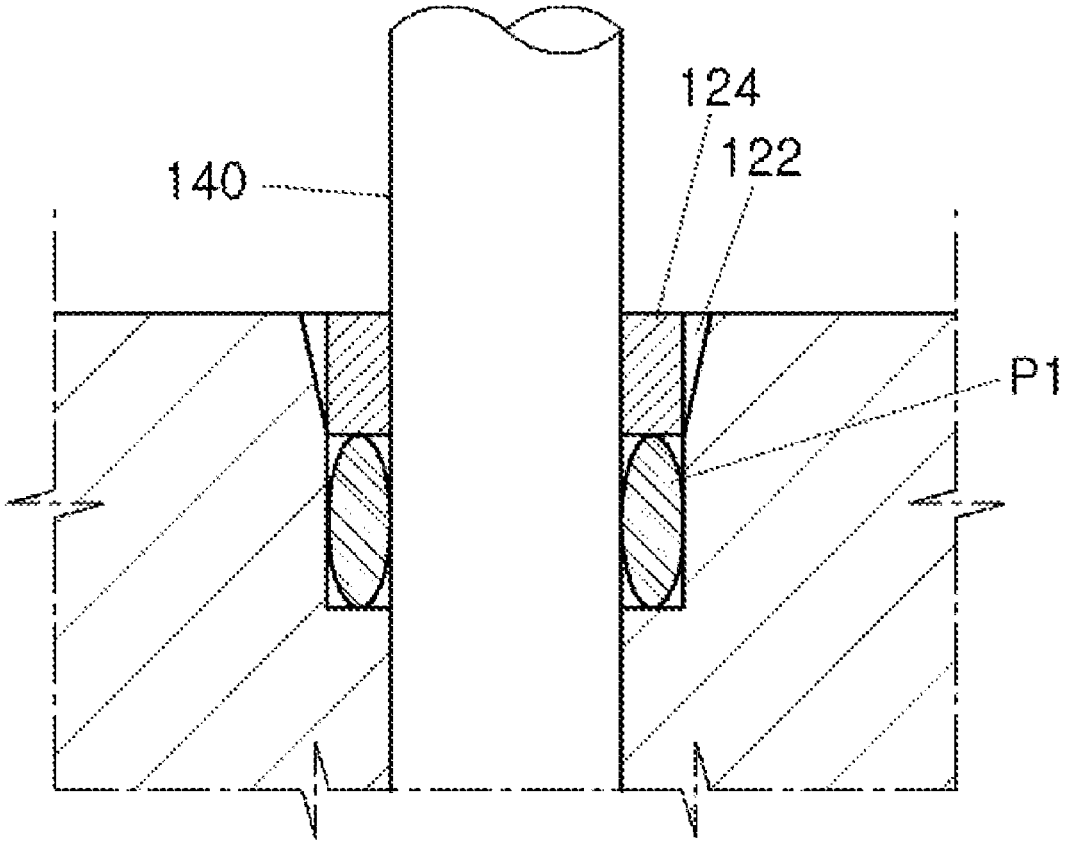

[FIG. 4]
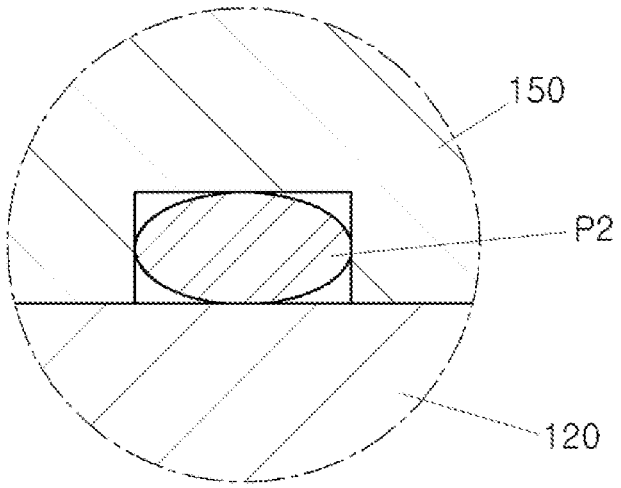

[FIG. 5]
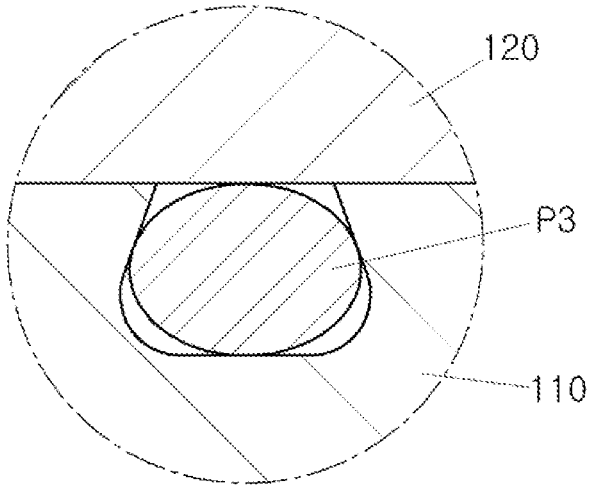

[FIG. 6]
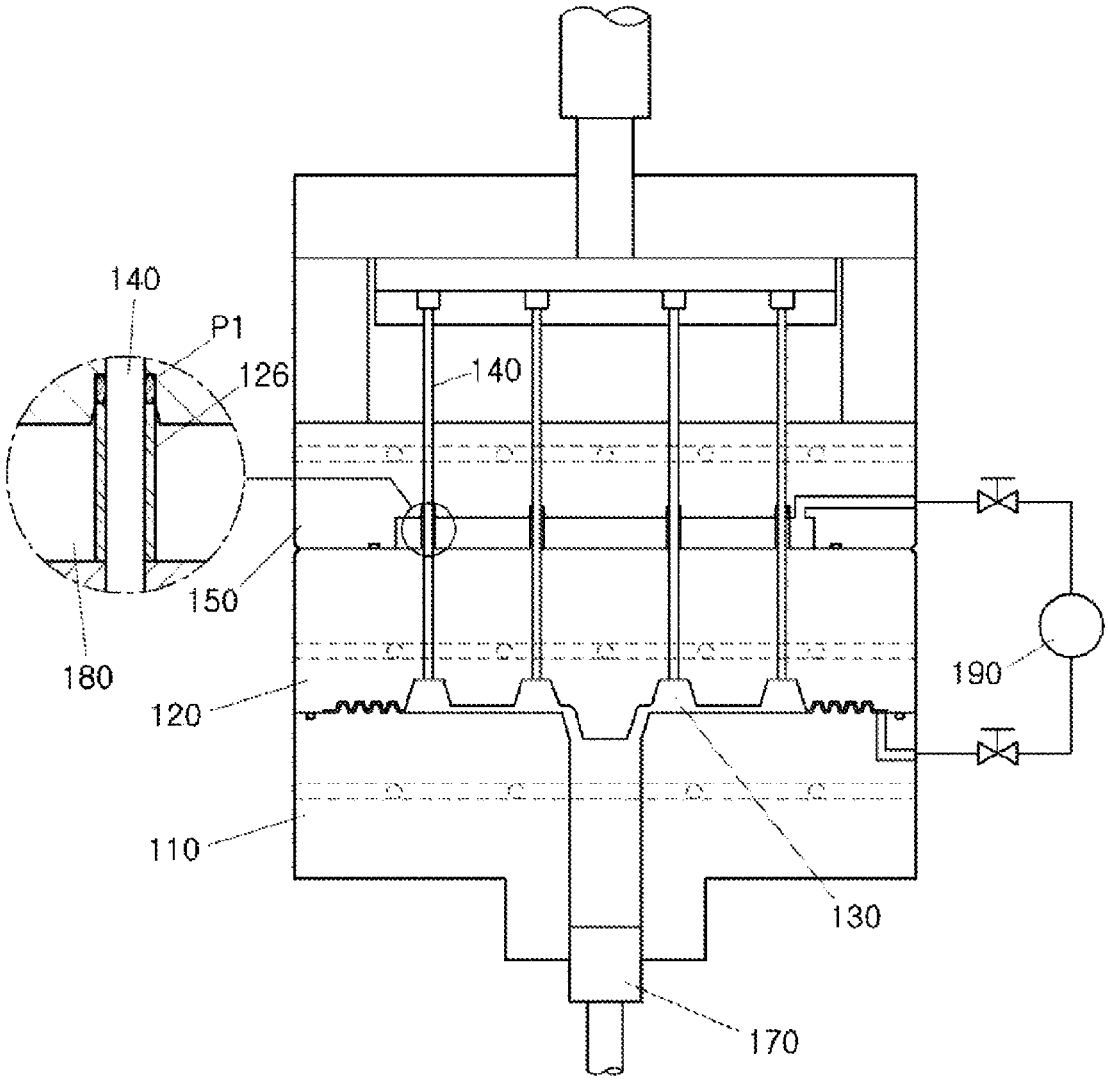

[FIG. 7]
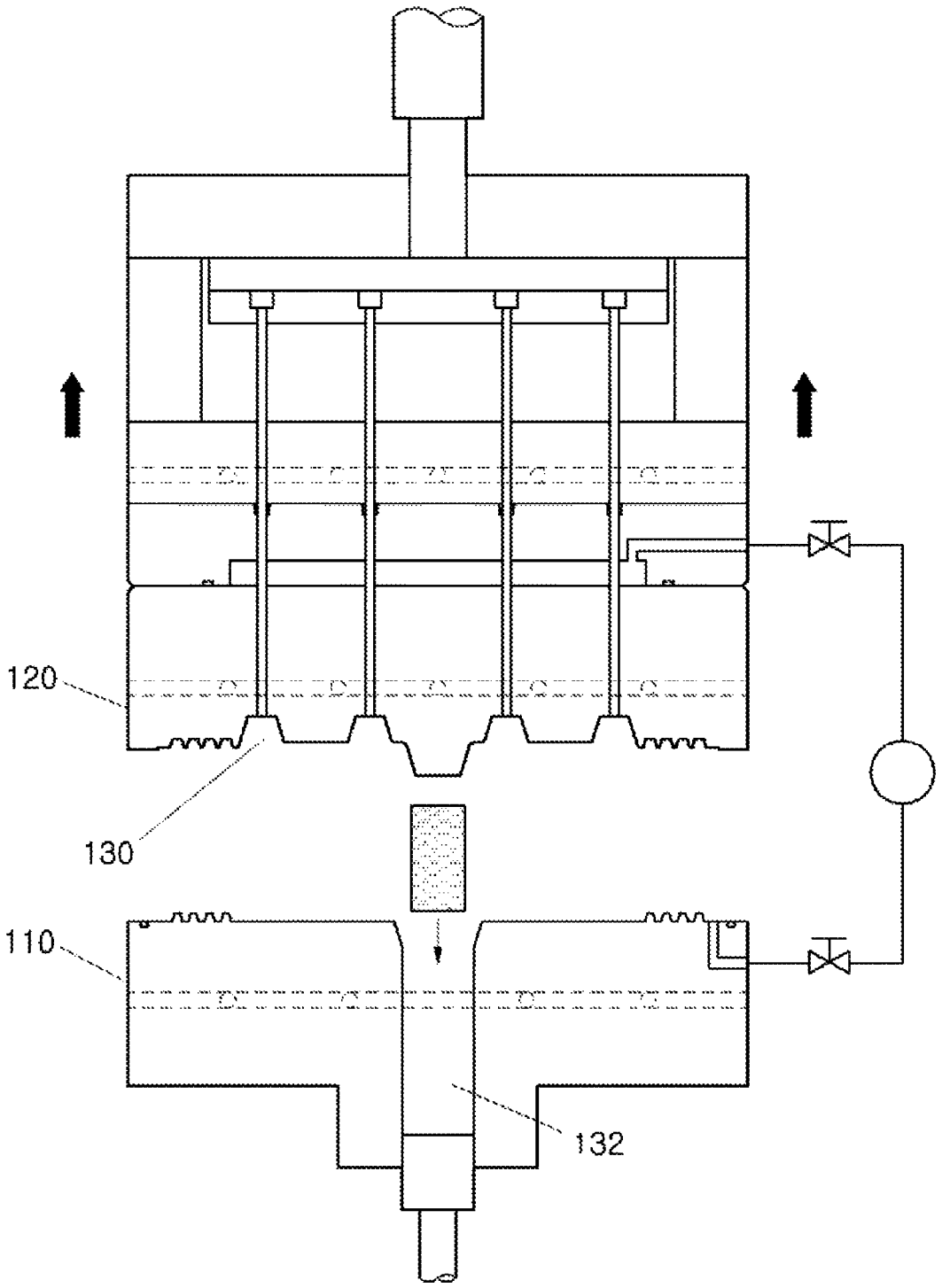

[FIG. 8]
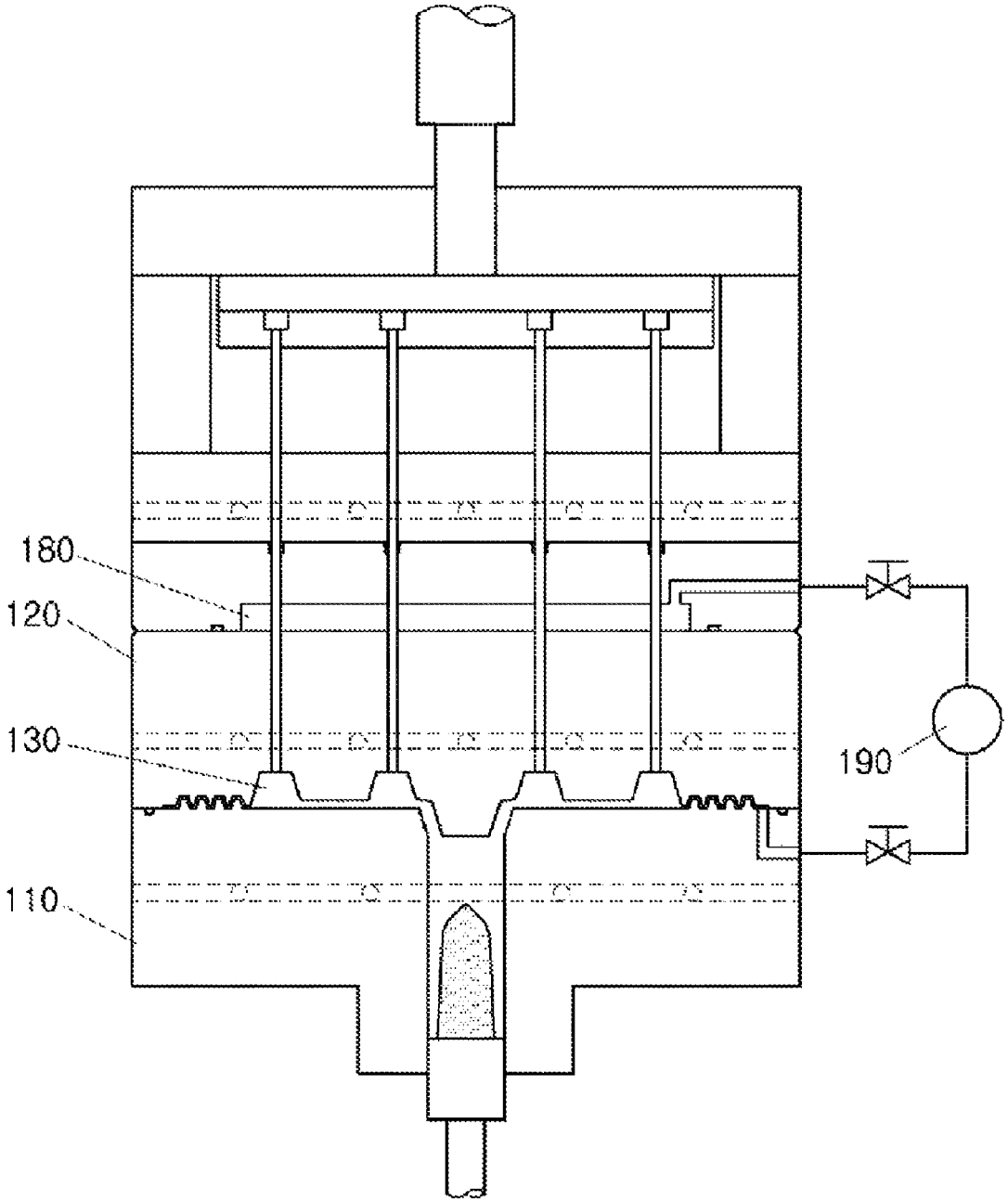

[FIG. 9]
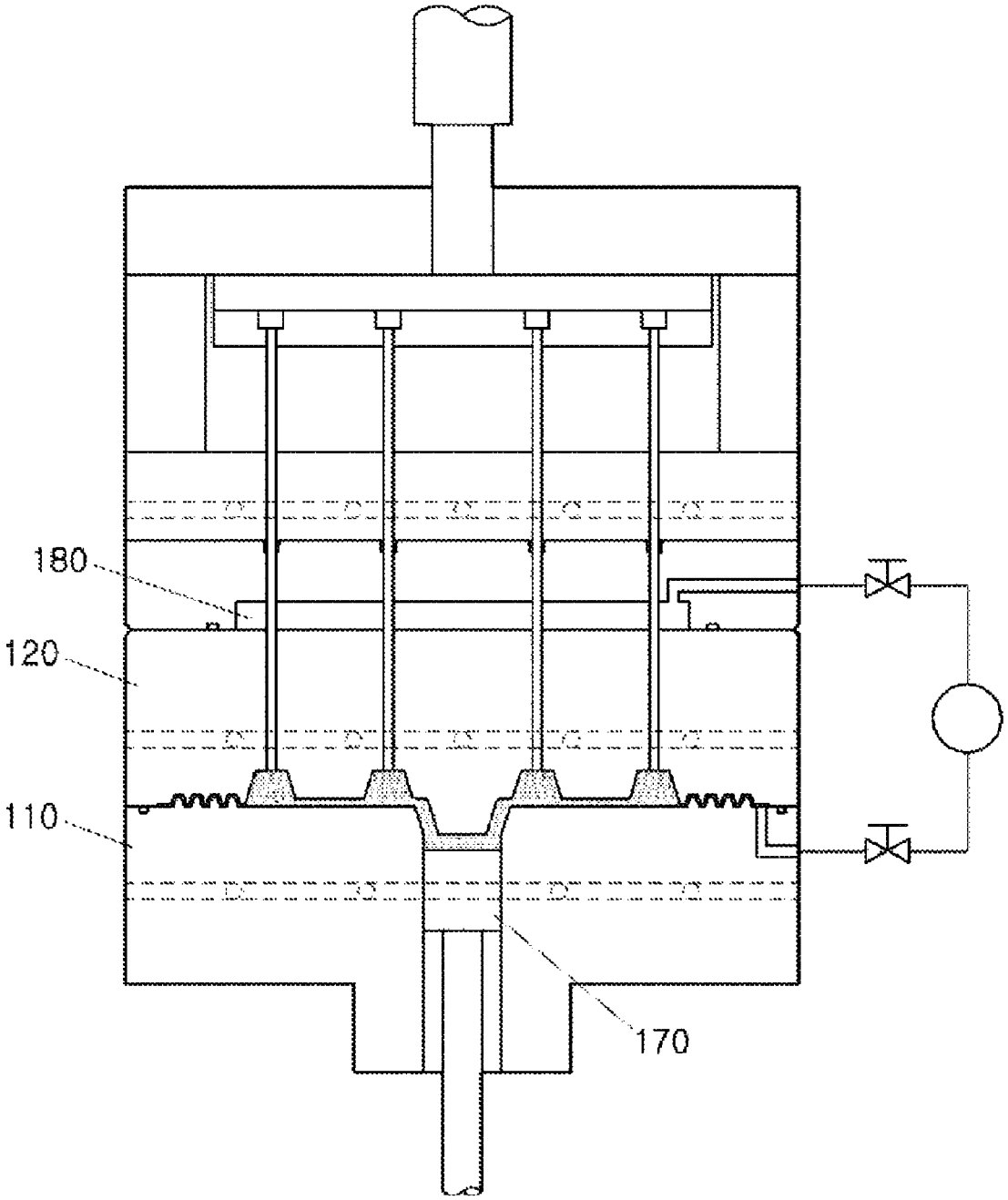

[FIG. 10]
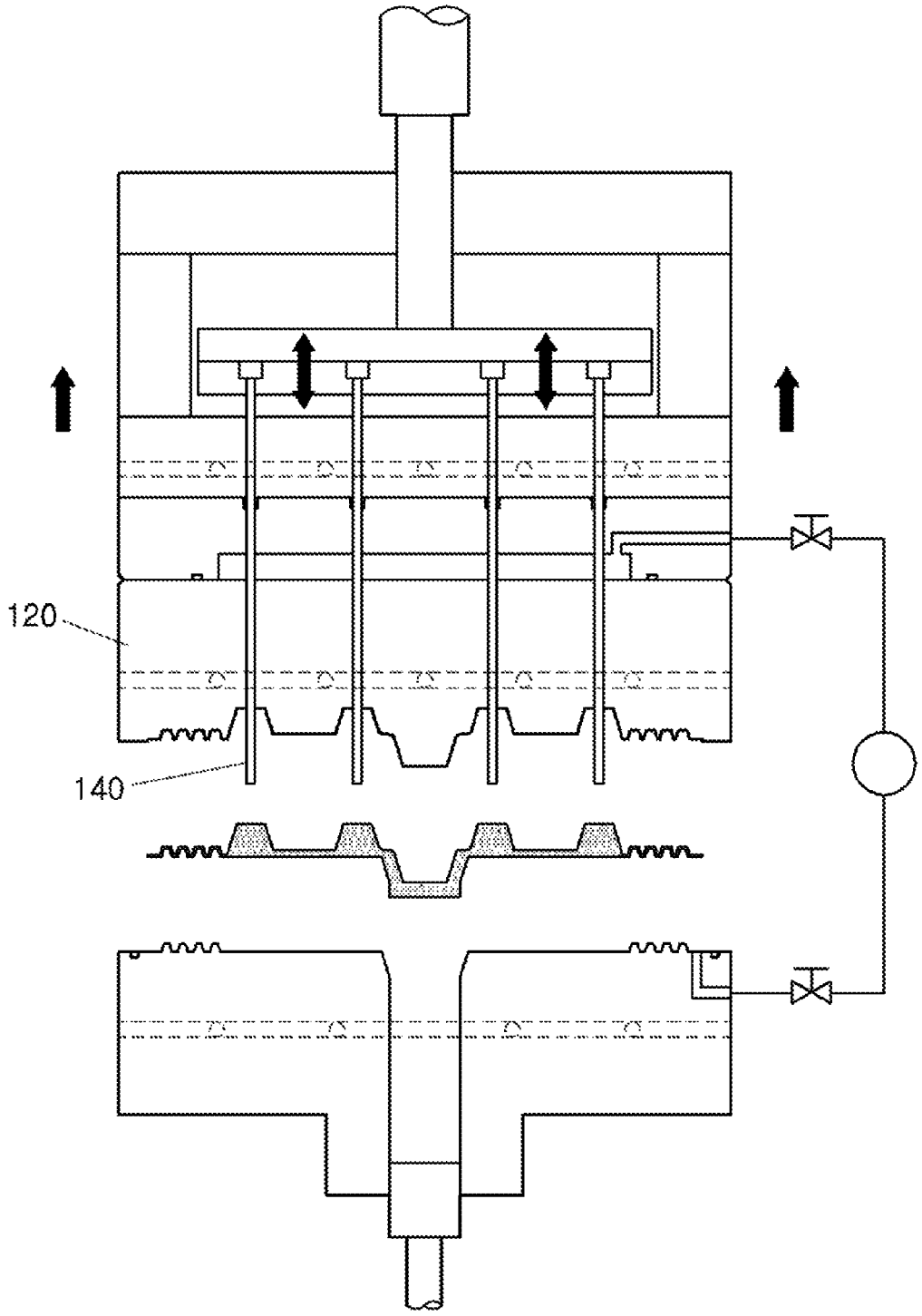

MOLD DEVICE FOR FORMING METAL IN HIGH-LEVEL VACUUM ENVIRONMENT

CROSS-REFERENCES

This application is a 371 of PCT/KR2015/005676 filed Jun. 5, 2015, which claims the benefit of foreign priority of Korean Patent Application No. 10-2014-0086829 filed Jul. 10, 2014, the subject matter of which is hereby incorporated by reference in its entirety.

TECHNICAL FIELD

The present invention generally relates to a mold device for forming metal within a metal-forming cavity in a high-level vacuum environment.

BACKGROUND

Metal is formed by a variety of methods, typical examples of which include mold casting and forging. Casting and forging are suitable for mass production since metal can be rapidly and accurately formed thereby.

A mold device for casting or forging has a cavity, a space in which a product is formed, formed by a movable mold and a fixed mold assembled together. After metal is melted by heating, the resulting molten metal is injected into the cavity to fill the cavity (casting) or is solidified by pressurizing the molten metal (forging). Afterwards, the movable mold is separated from the fixed mold, and a formed product is subsequently taken out.

In this case, the formed product is taken out by removing the formed product from the movable mold using ejector pins. When the movable mold is separated from the fixed mold, the formed product remains attached to the movable mold. Since the length of the ejector pins extends through the movable mold to the cavity, the ejector pins are moved towards the cavity by a cylinder to push against the formed product, thereby detaching the formed product from the movable mold.

In the process of forming molten metal, the molten metal rapidly oxides through contact with air, and this also allows introduction of impurities into the molten metal, thereby forming dross. Although the dross reduces the contact of the molten metal with the air, the dross impedes continuous stirring during melting of the metal, thereby reducing the high-quality of the molten metal. In order to overcome this problem, mold devices for forming metal in a vacuum environment have been proposed.

However, in mold devices that use ejector pins to eject out a formed metal product, it is difficult to create a high-level vacuum environment because of small gaps between the ejector pins and the hole through which the ejector pin extends. These small gaps can allow atmospheric air to enter the mold cavity.

SUMMARY

Accordingly, the present invention seeks a mold device that is more effective at preventing atmospheric air from entering the mold cavity. In the present invention, there is packing between the ejector pin and the hole through which the ejector pin extends in order to prevent air from entering the cavity when creating a vacuum environment within the cavity.

According to the present invention, the metal can be formed in a high-level vacuum environment created in the metal-forming space. It is therefore possible to prevent the properties of the molten metal from changing through contact with the air and to minimize the damage in the packing caused by heat. The packing prevents the atmospheric air from entering the metal-forming space. Since inexpensive packing may be used, the metal-forming operation can be performed more economically.

BRIEF DESCRIPTION OF DRAWINGS

FIG. 1 is an exemplary view schematically illustrating the configuration of a mold device according to the present invention;

FIG. 2 is an exploded view of part "A" in FIG. 1;

FIG. 3 is a cross-sectional view of part "A" in FIG. 1;

FIG. 4 is a cross-sectional view of part "B" in FIG. 1;

FIG. 5 is a cross-sectional view of part "C" in FIG. 1;

FIG. 6 is an exemplary view schematically illustrating the configuration of a mold device; and FIGS. 7 to 10 are exemplary views illustrating a process of forming a metal product.

DETAILED DESCRIPTION

The present invention provides a mold device that is more effective at preventing atmospheric air from entering a cavity through a gap between an ejector pin and a hole through which the ejector pin extends. This allows metal to be formed in a high-level vacuum environment maintained within the cavity.

In the mold device, a cavity is formed in the portion in which a movable mold adjoins a fixed mold, and an ejector pin extends through the movable mold to the cavity. After a vacuum environment is created within the cavity using an exhaust unit, molten metal is filled into the cavity where it is formed into a metal product. The ejector pin pushes out the formed metal product.

Packing is disposed between the ejector pin and a hole through which the ejector pin extends in order to prevent air from entering the cavity when creating a vacuum environment within the cavity. A blocking space is formed in front of the packing to block the transfer of heat to the packing.

The preferred embodiment will now be described in greater detail with reference to FIGS. 1 to 10.

FIG. 1 is an exemplary view schematically illustrating the configuration of a mold device according to the preferred embodiment. FIG. 2 is an exploded view of part "A" in FIG. 1. FIG. 3 is a cross-sectional view of part "A" in FIG. 1. FIG. 4 is a cross-sectional view of part "B" in FIG. 1. FIG. 5 is a cross-sectional view of part "C" in FIG. 1.

As illustrated in the drawings, the mold device according to the preferred embodiment includes a fixed mold 110 and a movable mold 120. A cavity 130, (or a space in which molten metal is filled and formed), is defined in the portion in which the movable mold 120 adjoins the fixed mold 110. A pressing-melting part 132 in which metal is to be heated is provided in the lower part of the cavity 130. A pressing plunger 170 is disposed in the pressing-melting part 132 in order to push molten metal produced in the pressing-melting part 132 into the cavity 130, such that the molten metal fills the cavity 130.

The fixed mold 110 is a mold that is fixed in position. The movable mold 120 is configured to move forwards, i.e. move in the direction toward the fixed mold 110, or move backwards, i.e. move in the direction away from the fixed mold 110. When the movable mold 120 moves backwards, the cavity 130 is opened.

Ejector pins 140 serving to eject a formed metal product from the cavity 130 are provided on the movable mold 120. The ejector pins 140 are in a rod shape, preferably, having a circular cross-section. One or a plurality of ejector pins may be provided. The ejector pins 140 extend through the movable mold 120, with the distal ends reaching the cavity 130. The ejector pins 140 are configured to move forwards in the direction in which the distal ends protrude or move backwards in the opposite direction, such that the distal ends thereof protrude from the cavity 130 to detach the formed metal product from the movable mold 120.

The cavity 130 is subjected to a vacuum environment. Air is drawn from the cavity 130 using an exhaust unit 190 that is separately provided, thereby creating the vacuum environment. The exhaust unit 190 draws the air through at least one exhaust pipe, thereby creating the vacuum environment within the cavity 130.

Packing P3 is disposed along the outer circumference of the cavity 130, in the portion in which the movable mold 120 adjoins the fixed mold 110, as illustrated in FIG. 5. This configuration prevents atmospheric air from entering the cavity 130 during the process of creating a vacuum environment within the cavity 130 or after the vacuum environment is created within the cavity 130.

In addition, according to the preferred embodiment, packing P1 is disposed between each of the ejector pins 140 and a hole through which the ejector pin 140 extends. This configuration can block air that would otherwise enter the cavity 130 through the hole, thereby creating a vacuum environment within the cavity 130.

The packing P1 is disposed at the entrance of the hole through which the ejector pin 140 extends. In this case, as illustrated in FIGS. 2 and 3, packing P1 is seated in a packing recess 122 that is located at the entrance of the hole, such that the packing P1 is accommodated in the packing recess 122 without being externally exposed. A washer ring 124 is fitted into the entrance of the packing recess 122 in order to prevent the packing P1 from being dislodged from the packing recess 122.

The packing recess 122 is in a funnel shape, with the diameter gradually decreasing from the wider entrance and remaining unchanged from a preset point. The packing P1 is seated in the portion of the packing recess 122, the diameter of which remains unchanged. When the washer ring 124 is provided, the packing recess 122 is configured such that the washer ring 124 can also be seated therein. This configuration allows the packing P1 to be more easily fitted into the packing recess 122.

A significant amount of heat is produced during the process of forming the metal product. In particular, the movable mold 120 is heated to a high temperature ranging from 200 to 300° C. when forming the metal product in order to prevent metal from being subjected to rapid thermal deformation. Heat produced in this process can damage the packing P1 disposed in the hole through which the ejector pin 140 extends.

This problem can be prevented by providing a blocking space 180 that can block heat from being transferred to the packing P1. The blocking space 180 is formed between the packing P1 and the movable mold 120 in order to prevent the heat of the movable mold 120 from being transferred to the packing P1.

The blocking space 180 can be formed using a closing plate 150. The closing plate 150 is in a plate shape placed on top of the movable mold 120, and the blocking space 180 is formed between the movable mold 120 and the closing plate 150. For example, the blocking space 180 can be a concave space formed in the portion of the closing plate 150 that the movable mold 120 adjoins.

It is preferable that the blocking space 180 formed as above be sealed with packing P2. As illustrated in FIG. 4, the packing P2 is disposed along the outer circumference of the blocking space 180 between the closing plate 150 and the movable mold 120.

In this particular configuration, the ejector pin 140 extends to the cavity 130 through the blocking space 180 and the movable plate 120. The packing P1 is disposed in the top surface of the closing plate 150, in particular, at the entrance of the hole through which the ejector pin 140 extends. The packing recess 122 is formed in the portion of the closing plate 150 in which the packing P1 is disposed, and the washer ring 124 is fitted into the packing recess 122.

In this particular configuration, the exhaust unit 190 draws air from both the cavity 130 and the blocking space 180.

The blocking space 180 is a hollow space preventing heat produced from the movable mold 120 from being transferred to the packing P1. Consequently, the packing P1 is prevented from being damaged by heat. By using an inexpensive, relatively-low heat resistance material as the packing, production costs can be reduced.

A support plate 160 is placed on top of the closing plate 150 configured as above. The support plate 160 is in a plate shape. The support plate 160 is placed on top of the closing plate 150, and adjoins the closing plate 150. The support plate 160 can be separated from the closing plate 150 as required. Referring to the attached drawings, when the support plate 160 is moved upwards, the support plate 160 is separated from the closing plate 150. In this state, the packing P1 can be left in place or replaced with new packing.

The packing P1 is disposed between the closing plate 150 and the support plate 160 as described above, and is pressed by the support plate 160 such that the packing P1 is firmly supported. Consequently, the state in which the packing P1 is disposed can be firmly maintained.

FIG. 6 is an exemplary view schematically illustrating the configuration of a mold device according to another embodiment of the present invention.

As illustrated in FIG. 6, in the mold device according to another embodiment of the preferred embodiment, the closing plate 150 is closely placed on top of the movable mold 120. The blocking space 180 is formed between the movable mold 120 and the closing plate 150. The ejector pins 140 sequentially extend through the closing plate 150 and the movable mold 120. This configuration precludes the need for the support plate 160 (see FIG. 1) from the preferred embodiment.

According to the preferred embodiment, the packing P1 is disposed at the bottom surface of the closing plate 150, in particular, at the entrance of the hole through which the corresponding ejector pin 140 extends. In this case, there is a cylindrical rod 126 that prevents the packing P1 from being dislodged. The cylindrical rod 126 is erected within the blocking space 180, with the upper end thereof supporting and pressing the packing P1, and the lower end thereof being supported on the movable mold 120. With this configuration, the ejector pin 140 extends through the cylindrical rod 126 to extend through the movable mold 120. The cylindrical rod 126 isolates the ejector pin 140 from the blocking space 180 while preventing the packing P1 from being dislodged.

It is preferable that the cylindrical rod 126 be formed of an insulating material, but this is not intended to be limiting.

In FIG. 6, reference numerals that are not referred to indicate the same components as in the preferred embodiment, and descriptions thereof will be omitted. Reference will now be made to a process of forming a product from molten metal using the mold device according to the preferred embodiment. FIGS. 7 to 10 are exemplary views illustrating the process of forming a metal product using the mold device according to the preferred embodiment.

First, as illustrated in FIG. 7, the movable mold 120 is moved upwards, and the cavity 130 and the pressing-melting part 132 disposed in the lower part of the cavity 130 are cleaned. Cleaning is performed by blowing high-pressure air into the pressing-melting part 132, and after the cleaning, a releasing agent and a lubricant are injected.

After the cleaning, metal is loaded into the pressing-melting part 132 while being heated, and the movable mold 120 is simultaneously moved downwards. Consequently, as illustrated in FIG. 8, the movable mold 120 is assembled to the fixed mold 110. The exhaust unit 190 is subsequently operated to draw air from both the cavity 130 and the blocking space 180. When the operation of drawing the air is completed, a valve is closed, thereby creating a high-level vacuum environment.

When the loaded metal is sufficiently heated to melt, as illustrated in FIG. 9, the pressing plunger 170 is moved upwards, thereby filling the cavity 130 with molten metal. Afterwards, the molten metal is left to cool in this state for a preset time, such that a metal product is formed in the shape of the mold cavity 130. Although the movable mold 120 is heated to a preset temperature, the blocking space 180 blocks the transfer of heat produced from the movable mold 120.

Thereafter, cooling is completed, as illustrated in FIG. 10, and the movable mold 120 is moved upwards again. At this time, the formed product is moved upwards, which is attached to the movable mold 120. The formed metal product is removed from the movable mold 120 by moving the ejector pins 140 towards the formed metal product.

Finally, the metal product removed from the mold is finished through a post treatment process, such as polishing or painting. By repeating the above-described process, it is possible to continuously form metal in a high-level vacuum environment.

Therefore, the present invention has been described in terms of a preferred embodiment, it is apparent that other forms could be adopted by one skilled in the art. Accordingly, it should be understood that the present invention is not limited to the preferred embodiment illustrated in the Figures. It should also be understood that the phraseology and terminology employed above are for the purpose of disclosing the illustrated embodiment, and do not necessarily serve as limitations to the scope of the invention.

The invention claimed is:

1. A mold device for forming metal, comprising:

a fixed mold;

a movable mold adjoining an upper portion of the fixed mold to form a mold cavity;

an ejector pin extending through the movable mold and into the mold cavity;

an exhaust unit that draws air from the mold cavity, thereby creating a vacuum environment within the mold cavity;

a closing plate placed on top of the movable mold such that the ejector pin sequentially extends through the closing plate and the movable mold;

a packing disposed in a hole of the closing plate through which the ejector pin extends, the packing preventing atmospheric air from entering the mold cavity; and a blocking space between the movable mold and the packing to prevent heat from being transferred to the packing wherein the packing is disposed at an entrance of the hole at a bottom surface of the closing plate through which the ejector pin extends, and the mold device further comprising a cylindrical rod disposed within the blocking space, an upper end of the cylindrical rod supporting and pressing against the packing, a lower end of the cylindrical rod being supported on the movable mold, and the ejector pin extending through the cylindrical rod.

2. The mold device according to claim 1, wherein the packing is fitted into a packing recess at an entrance of a hole of the closing plate through which the ejector pin extends, and the mold device further comprising a washer ring fitted into an entrance of the packing recess to prevent the packing from being dislodged.

3. A mold device for forming metal, comprising:

a fixed mold;

a movable mold adjoining an upper portion of the fixed mold to form a mold cavity;

an ejector pin extending through the movable mold and into the mold cavity;

an exhaust unit that draws air from the mold cavity, thereby creating a vacuum environment within the mold cavity;

a closing plate placed on top of the movable mold such that the ejector pin sequentially extends through the closing plate and the movable mold;

a packing disposed in a hole of the closing plate through which the ejector pin extends, the packing preventing atmospheric air from entering the mold cavity; and a blocking space between the movable mold and the packing to prevent heat from being transferred to the packing wherein the packing is disposed at an entrance of the hole at a bottom surface of the closing plate through which the ejector pin extends; and the mold device further comprising a cylindrical rod disposed within the blocking space, an upper end of the cylindrical rod supporting and pressing against the packing, a lower end of the cylindrical rod being supported on the movable mold, and the ejector pin extending through the cylindrical rod wherein the exhaust unit draws air from both the mold cavity and the blocking space.

* * * * *